US009073089B2

(12) United States Patent
Armstrong

(10) Patent No.: US 9,073,089 B2
(45) Date of Patent: Jul. 7, 2015

(54) ORE SCREENING PANEL

(75) Inventor: Richard Armstrong, Perth (AU)

(73) Assignee: SCHENCK PROCESS AUSTRALIA PTY LTD (AU)

( * ) Notice: Subject to any disclaimer, the term of this patent is extended or adjusted under 35 U.S.C. 154(b) by 0 days.

(21) Appl. No.: 14/240,072

(22) PCT Filed: Aug. 21, 2012

(86) PCT No.: PCT/AU2012/000978

§ 371 (c)(1),
(2), (4) Date: May 19, 2014

(87) PCT Pub. No.: WO2013/026090

PCT Pub. Date: Feb. 28, 2013

(65) Prior Publication Data

US 2014/0291215 A1 Oct. 2, 2014

(30) Foreign Application Priority Data

Aug. 22, 2011 (AU) ..... 2011903335

(51) Int. Cl.

| | |
|---|---|
| ***B07B 9/00*** | (2006.01) |
| ***B07B 1/28*** | (2006.01) |
| ***B07B 1/46*** | (2006.01) |
| ***B07B 13/18*** | (2006.01) |

(52) U.S. Cl.

CPC ..... *B07B 1/28* (2013.01); *B07B 1/4645* (2013.01); *B07B 1/469* (2013.01); *B07B 13/18* (2013.01)

(58) Field of Classification Search

USPC ..... 209/233, 392, 397, 400

See application file for complete search history.

(56) References Cited

U.S. PATENT DOCUMENTS

| | | | | |
|---|---|---|---|---|
| 2008/0105598 | A1* | 5/2008 | Fisher et al. | 209/402 |
| 2011/0303587 | A1* | 12/2011 | Doppstadt et al. | 209/672 |
| 2012/0061029 | A1* | 3/2012 | Weston | 160/6 |
| 2014/0021107 | A1* | 1/2014 | Yaver | 209/392 |

FOREIGN PATENT DOCUMENTS

| | | | |
|---|---|---|---|
| CN | 2047994 | | 11/1989 |
| CN | 201130139 | | 10/2008 |
| CN | 201130139 | Y * | 10/2008 |
| CN | 201361617 | | 12/2009 |
| DE | 2634934 | | 11/1977 |
| JP | 2009106866 | | 5/2009 |
| KR | 100770755 | | 1/2008 |

* cited by examiner

*Primary Examiner* — Terrell Matthews

(74) *Attorney, Agent, or Firm* — The Belles Group, P.C.

(57) ABSTRACT

A modular screening panel in which the apertures in the screening surface extend through the surface and the shape of the aperture parallel the plane of the panel surface varies with the depth of the aperture so that as the surface wears the visible shape of the aperture changes. The apertures can be any convenient shape at the surface but at the depth which means the worn panel needs replacing the shape is distinctly different to the shape of the apertures in a new or partly worn panel.

3 Claims, 2 Drawing Sheets

ORE SCREENING PANEL

PRIORITY

Priority is claimed as a national stage application, under 35 U.S.C. §371, to international application No. PCT/AU2012/000978, filed Aug. 21, 2012, which claims priority to Australian application 2011903335, filed Aug. 22, 2011. The disclosures of the aforementioned priority applications are incorporated herein by reference in their entirety.

This invention relates to modular panels used in vibratory screening machines of the type used in mining and quarrying.

BACKGROUND TO THE INVENTION

Australian patent 482212 proposed a modular screening panel system for ore screening decks which is now widely used by the mining industry and replaced the earlier screening cloths, and large wire screening frames. The screening panels were all of the same size [eg. 300 mm] and made of reinforced polyurethane. The panels are adapted to be secured to an underlying support frame using dependent spigots which are a force fit into corresponding apertures in the support frame. The underlying support frame was designed specifically for the panels and itself was secured to the machine frame fitted as original equipment by the screening machine manufacturer.

The panels become worn and need to be replaced. The wear patterns across a screen deck are not easy to predict and not all panels in a deck need to be replaced. Hard wearing Rubber and Polyurethane panels are used to provide the optimal working life for the panels.

Patent specification WO02/074453 discloses a screening surface having two layers bonded together. There is an indication that the under layer may be of a different colour to the top surface to provide an indication that the worn panel needs replacing. This involves a more expensive process for making the panels. Another known system of wear indication is to provide closed apertures in part of the panels which open when a portion of the surface is worn. This has the disadvantage of reducing the open area of the screen and only indicates wear in the localized area of the closed aperture.

It is an object of this invention to provide a more convenient means of identifying wear without reducing open area or increasing manufacturing costs.

BRIEF DESCRIPTION OF THE INVENTION

To this end the present invention provides a modular screening panel in which the apertures in the screening surface extend through the surface and the shape of the aperture parallel the plane of the panel surface varies with the depth of the aperture so that as the surface wears the visible shape of the aperture changes. The apertures can be any convenient shape at the surface but at the depth which means the worn panel needs replacing the shape is distinctly different to the shape of the apertures in a new or partly worn panel. It may be convenient to provide an intermediate shape to provide an early warning of the progress of wear. It is, preferred that two opposed sides of the aperture change from being curved to being square.

Another advantage of the present invention is that the wear indication system has a positive benefit to the flexibility of the screening surface and its screening efficiency. The change in shape along the depth of the aperture slightly increases the size of the aperture at its lower extremity, which contributes to improved flexibility and less likelihood of blinding.

DETAILED DESCRIPTION OF THE INVENTION

A preferred embodiment of the invention will be described with reference to the drawings in which.

Figure 3:
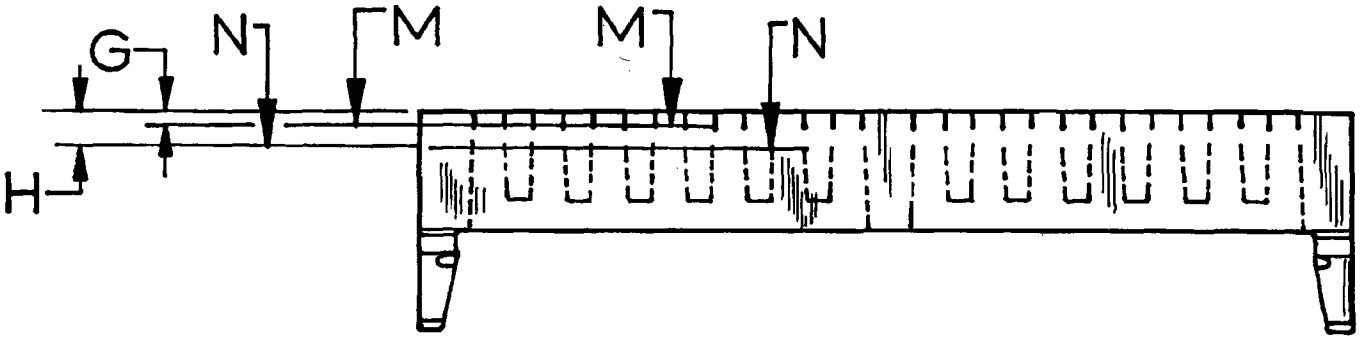
Figure 5:
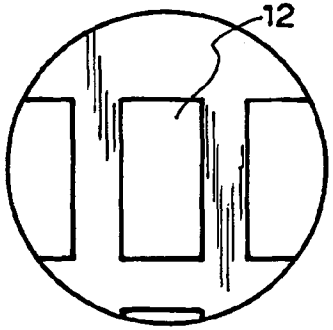
Figure 4:
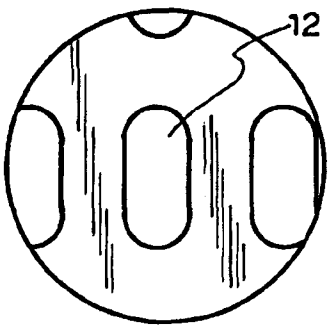
Figure 6:
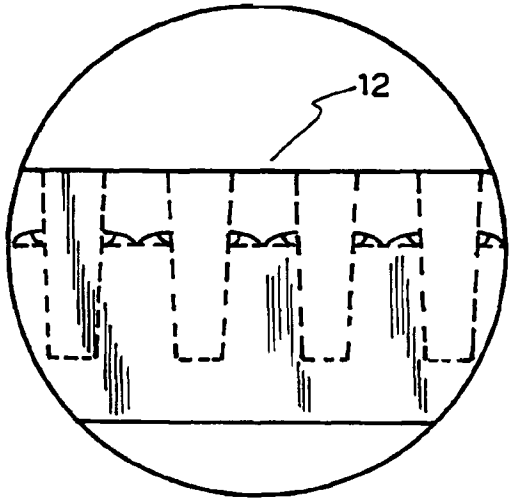

FIG. 3 section view of the panel showing the depth of the apertures;

FIG. 4 is a plan view along the line M-M of FIG. 3;

FIG. 5 is a plan view along the line N-N of FIG. 3;

FIG. 6 is a detail view of the cross section of FIG. 3.

Figures 1, 2:
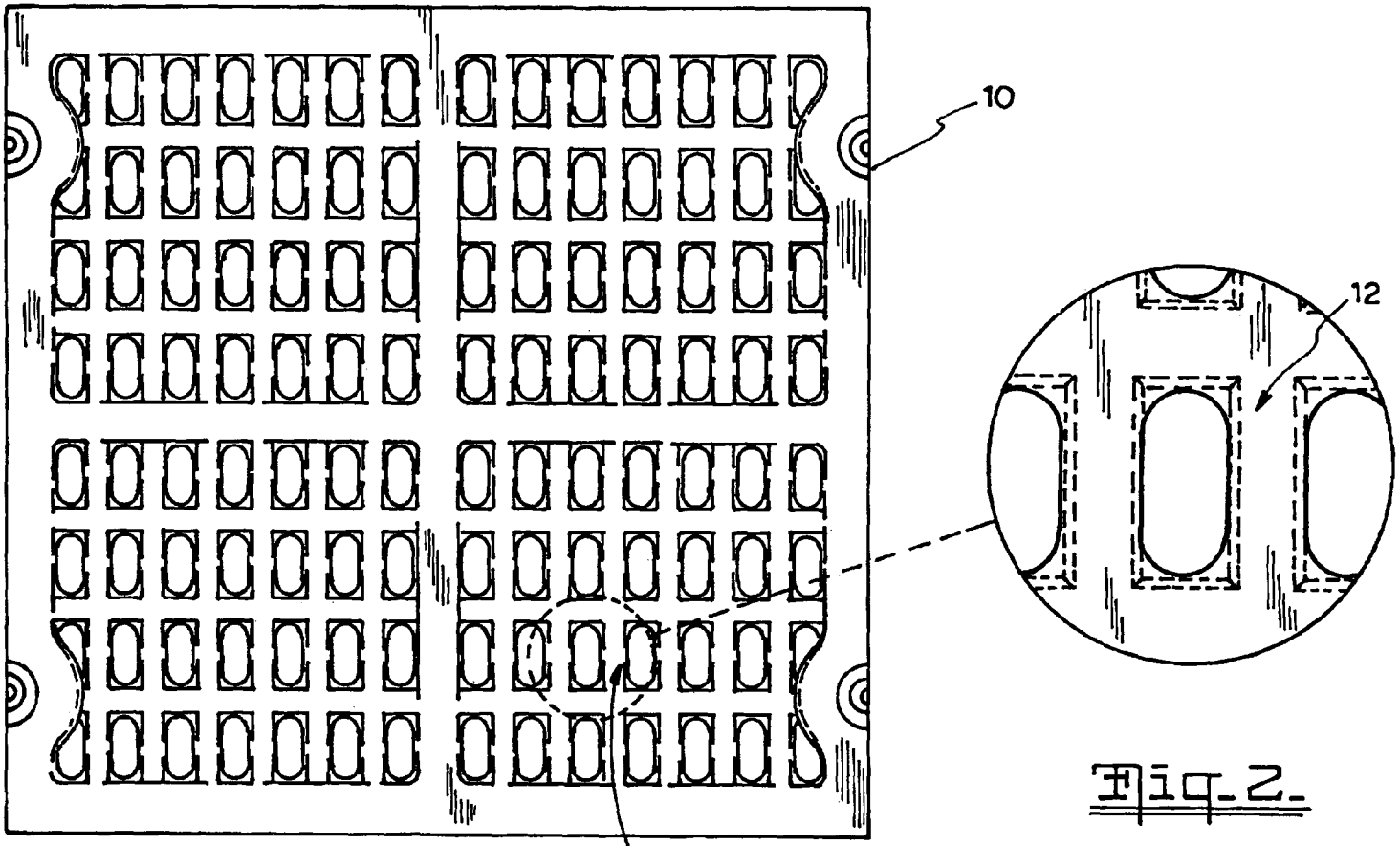
FIG. 1 is a plan view of the screening surface of one embodiment of the invention.
FIG. 2 is a detail view of the screening apertures in the panel of FIG. 1.

FIG. 1, as a plan view, is identical to a conventional screening panel 10 and the apertures 12 detailed in FIG. 2 are conventional. This invention is not limited to the selection of any particular aperture shape any conventional shape can be substituted for that shown in FIGS. 1 and 2.

FIG. 3 is a cross sectional view of the panel of claim 1 and FIG. 6 is a detailed view, FIG. 4 illustrates that at a depth G as seen along the line M-M of FIG. 3 the shape of the aperture remains the same as at the surface as shown in FIGS. 1 and 2.

However when the wearing of the surface proceeds to a depth H as shown along the line N-N of FIG. 3, the shape of the aperture has changed and provides a visible indication that the panel surface has worn to the extent that the panel needs to be replaced.

The selection of the depth H will depend on the viability of the worn panel when its thickness has been reduced to that extent. This will depend on whether reinforcing materials are exposed and on the characteristics of the panel material. The preferred materials are hard grades of polyurethane or rubber. The change in aperture is easily achieved by making a simple change to the moulding tool to reflect the change in aperture shape. Those skilled in the art can easily select the most visible and detectable shape change for each particular screening deck.

From the above it can be seen that this invention provides a wear indicator that is easy to identify without involving extra manufacturing steps or interfering with the open area of the screening, surface.

Those skilled in the art will realize that this invention has been described with reference to one particular embodiment but may be implemented with any suitable aperture shape and change in shape.

The invention claimed is:

1. A modular screening panel comprising a screening surface and a plurality of apertures extending through the screening surface, wherein a shape of each aperture parallel to the plane of the screening surface varies with a depth of the aperture, so that as the screening surface wears, a visible shape of the aperture changes, wherein the shape of each aperture changes at a predetermined depth to indicate that the panel needs to be replaced.

2. The modular screening panel as claimed in claim 1 wherein two opposed sides of each aperture change from being curved to being square.

3. The modular screening panel as claimed in claim 1 wherein the change in shape slightly increases a size of each aperture at its lower extremity, which contributes to improved flexibility and less likelihood of blinding.

* * * * *